US010858891B2

(12) United States Patent
Rostvall et al.

(10) Patent No.: US 10,858,891 B2
(45) Date of Patent: Dec. 8, 2020

(54) DRILL BIT INSERT FOR ROCK DRILLING

(71) Applicant: EPIROC DRILLING TOOLS AKTIEBOLAG, Fagersta (SE)

(72) Inventors: Tomas Rostvall, Stockholm (SE); Niklas Ahlén, Söderbärke (SE)

(73) Assignee: EPIROC DRILLING TOOLS AKTIEBOLAG, Fagersta (SE)

( * ) Notice: Subject to any disclaimer, the term of this patent is extended or adjusted under 35 U.S.C. 154(b) by 0 days.

(21) Appl. No.: 16/461,400

(22) PCT Filed: Nov. 17, 2017

(86) PCT No.: PCT/SE2017/051142
§ 371 (c)(1),
(2) Date: May 16, 2019

(87) PCT Pub. No.: WO2018/093326
PCT Pub. Date: May 24, 2018

(65) Prior Publication Data

US 2019/0345773 A1 Nov. 14, 2019

(30) Foreign Application Priority Data

Nov. 18, 2016 (SE) ..... 1630268

(51) Int. Cl.
*E21B 10/56* (2006.01)
*E21B 10/36* (2006.01)

(52) U.S. Cl.
CPC ..... *E21B 10/56* (2013.01); *E21B 10/36* (2013.01)

(58) Field of Classification Search
CPC ..... E21B 10/56; E21B 10/36
See application file for complete search history.

(56) References Cited

U.S. PATENT DOCUMENTS 5,305,840 A 4/1994 Liang et al.
6,673,307 B1 1/2004 Lindholm et al.
(Continued)

FOREIGN PATENT DOCUMENTS

CN 104087790 A 10/2014
CN 104278953 A 1/2015
(Continued)

OTHER PUBLICATIONS

International Search Report and Written Opinion in corresponding international application No. PCT/SE2017/051142 dated Jan. 10, 2018 (9 pages).
(Continued)

*Primary Examiner* — Kristyn A Hall
(74) *Attorney, Agent, or Firm* — Venable LLP; Jeffri A. Kaminski

(57) ABSTRACT

Drill bit insert with a sintered cemented carbide body including a hard phase of tungsten carbide (WC) and a binder phase wherein the cemented carbide comprises 5.0-7.0 wt % Co, 0.10-0.35 wt % Cr, and a Cr/Co weight ratio of 0.015-0.058. The cemented carbide body has a hardness of 1520-1660 Hv30 and a toughness of $K1_c \geq 10.0$ both measured in the bulk at the center of the longitudinal axis through the center of the insert, or ≥5 mm from any surface of the insert. The insert further has a surface toughness $K1_c \geq 12.0$ measured at 0.5 mm below the surface of the body in a transverse direction to the longitudinal axis the insert. The invention also relates to a drill bit comprising the insert and the use of such a drill bit for drilling.

14 Claims, 4 Drawing Sheets

(56) References Cited

U.S. PATENT DOCUMENTS

Figure 1:
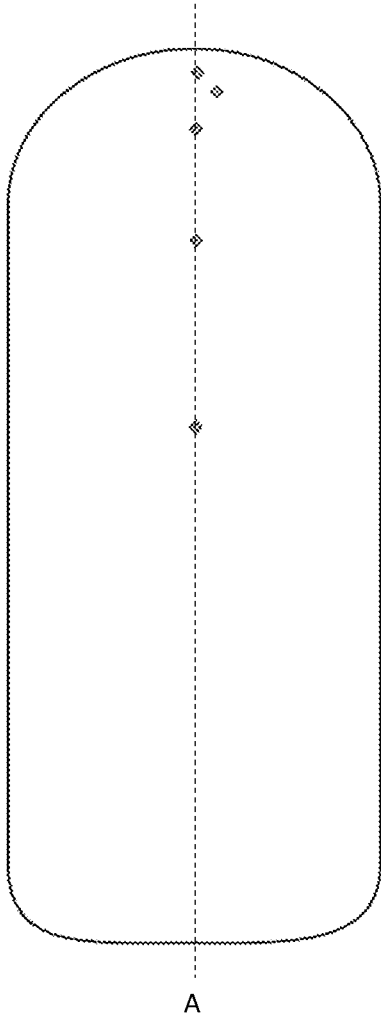

| | | | |
|---|---|---|---|
| 7,549,912 | B2 | 6/2009 | Liang et al. |
| 2005/0053511 | A1 | 3/2005 | Rainey et al. |
| 2008/0127776 | A1 | 6/2008 | Persson et al. |
| 2018/0161881 | A1* | 6/2018 | Akerman ..... C22C 1/056 |

FOREIGN PATENT DOCUMENTS

| | | | |
|---|---|---|---|
| CN | 105950937 | A | 9/2016 |
| CN | 107636249 | A | 1/2018 |
| EP | 1043412 | A1 | 10/2000 |
| EP | 1054071 | A2 | 11/2000 |
| EP | 1803830 | A1 | 7/2007 |
| JP | H06158114 | A | 6/1994 |
| WO | 9913120 | A1 | 3/1999 |
| WO | 2006056890 | A2 | 6/2006 |
| WO | 2009123543 | A1 | 10/2009 |
| WO | 2013135555 | A1 | 9/2013 |
| WO | 2016151025 | A1 | 9/2016 |
| WO | 2016186558 | A1 | 11/2016 |

OTHER PUBLICATIONS

Ulrik Beste et al; "Rock penetration into cemented carbide drill buttons during rock drilling"; Wear, vol. 264, No. 11-12; May 2008; pp. 1142-1151 (10 pages).

Extended European Search Report in corresponding European Application No. 17871336.8 dated Feb. 13, 2020 (9 pages).

G. Gille; "Submicron and ultrafine grained hardmetals for microdrills and metal cutting inserts"; vol. 20, Issue 1, 2002; pp. 3-22; ISSN 0263-4368; https://doi.org/10.1016/S0263-4368(01)00066-X. (http://www.sciencedirect.com/science/article/pii/S026343680100066X); Abstract only (3 pages).

Chinese Office Action in corresponding Chinese application No. 201780070877.X dated Jun. 8, 2020 (7 pages).

* cited by examiner

DRILL BIT INSERT FOR ROCK DRILLING

CROSS-REFERENCE TO RELATED APPLICATIONS

This application is a U.S. National Stage application of PCT/SE2017/051142, filed Nov. 17, 2017 and published on May 24, 2018 as WO/2018/093326, which claims the benefit of Swedish Patent Application No. 1630268-9, filed Nov. 18, 2016, all of which are hereby incorporated by reference in their entireties.

TECHNICAL FIELD

The present invention relates to a drill bit insert for rock drilling comprising a sintered cemented carbide body including a hard phase of tungsten carbide (WC) and a binder phase. The invention also relates to a drill bit comprising the insert and the use of such a drill bit for drilling.

BACKGROUND

Cemented carbide comprising a hard phase in a binder phase is commonly used for applications requiring hard and wear resistant materials such as metal cutting, metal forming and rock drilling. Often tungsten carbide (WC) is used as hard phase together with Cobalt (Co) as binder phase but other hard constituents such as Titanium carbide (TiC), Niobium Carbide (NbC) or Tantalum Carbide (TaC) can also be used together with Co alloyed with for example Iron (Fe) or Nickel (Ni).

For rock drilling a rock drill bit having a body of steel and cemented carbide inserts brazed or press fitted into holes in the steel body is commonly used. Rock drilling can be performed in several ways. One example is rotary drilling where a rotary drill bit with cemented carbide inserts cuts the rock using pressure and rotary motion. This is often used for large diameter holes. Another technique is percussive drilling where a top-hammer or down-the-hole rock drill is used to cut the rocks using percussive strokes that cracks and pulverize the rock. The drill bit is rotated an angle between each stroke so that the cemented carbide drill bit inserts will hit fresh rock and thus produce a hole. Percussive drilling is typically used for blast holes in hard rock in mines or at construction sites. Percussive drilling is a demanding application that requires hard and wear resistant drill bit inserts that also have a high toughness to cope with the percussive forces.

The hardness of a cemented carbide is generally controlled during manufacturing by the amount binder phase added in combination with grain size of the hard phase. Lower binder phase content and smaller hard phase grain size will result in a harder material. It is known to use cemented carbide having a hard phase of WC with a grain size of about 1-5 μm and a binder phase of about 6 weight % (wt %) for inserts for percussive rock drilling. Cemented carbide is normally manufactured using powder metallurgical steps such as mixing and milling the hard phase constituents together with the metal powder that will form the binder phase, pressing the powder mixture to a body of desired shape, sintering the body to consolidate the body into a material with the hard phase constituents in a binder phase matrix and finally perform finishing operations such as grinding on the sintered body. To suppress hard phase grain growth during sintering of the cemented carbide it is known to add grain growth inhibitors such as Chromium (Cr), Vanadium (V), Tantalum (Ta), Titanium (Ti) and Niobium (Nb), often in form of cubic carbides or nitrides, to the powder mixture for cemented carbide for metal cutting an metal forming applications. This has been proven often to be detrimental for cemented carbide for percussive rock drilling because the grain growth inhibiters will form brittle cubic carbides in the binder phase after sintering that will decrease the overall toughness of the cemented carbide.

WO 2016/151025 discloses examples of cemented carbide for rock drill buttons. One rock drill button comprises WC with a grain size of about 1.8 μm, about 6 wt % Co, and has a hardness of about 1400 HV3 and another rock drill bottom comprises WC with a grain size of about 2.1 μm, about 6 wt % Co, about 0.6 wt % Cr, and has a hardness of just below 1400 Hv3. It is suggested that a Cr to Co ratio of 0.043-0.19 is beneficial to improve corrosion resistance and to make the binder phase prone to transform from free fcc-phase to hcp-phase to absorb some of the energy during drilling. The transformation will thus harden the binder phase. It is also described as essential that the hardness of the drill button is not higher than 1500 Hv3, otherwise the cemented carbide drill bit buttons will be too brittle and prone to failure.

Attempts have been made to improve the wear resistance of cemented carbide bodies such as drill bit inserts by trying to improve the toughness and/or hardness of the surface region. A surface treatment is applied through vibration, tumbling or centrifugal treatment where the cemented carbide bodies are set in motion to collide with each other or the wall of the container to mechanically harden the surface through deformation hardening. WO 2009/123543, WO 2013/135555, US 2005/053511 and U.S. Pat. No. 7,549,912 all discloses different variants of such treatment methods.

There still remains a need to improve the wear resistance and service life a cemented carbide inserts for percussive drilling.

SUMMARY OF THE INVENTION

It is an object of the present invention to provide an improved drill bit insert for percussive rock drilling and/or for rotary drilling.

The object is achieved with a drill bit insert suitable for percussive rock drilling and/or for rotary drilling according to claim 1 comprising a sintered cemented carbide body including a hard phase of tungsten carbide (WC) and a binder phase wherein the cemented carbide comprises 5.0-7.0 wt % Co, 0.10-0.35 wt % Cr, and has a Cr/Co weight ratio of 0.015-0.058. The cemented carbide body has a bulk hardness of 1520 Hv30, preferably 1520-1660 Hv30 and a bulk toughness of $K1_c \geq 10.0$ MN*m^(−3/2) both measured in the bulk at the center of the longitudinal axis through the center of the insert, or 5 mm from any surface of the insert, preferably in a transverse direction to the longitudinal axis through the center of the insert. The insert further has a surface toughness $K1_c \geq 12.0$ measured at a distance of 0.5 mm below the surface of the body in a transverse direction to the longitudinal axis the insert. The cemented carbide of the insert may have a mean WC grain size value of 0.60-0.95 μm. The cemented carbide may, in addition to the constituents mentioned, comprise balance WC or further constituents including possible impurities.

A hard cemented carbide improves the wear resistance of an insert for percussive drilling, however due to the high energy of the percussive strokes during drilling the insert must also be sufficiently tough to avoid brittleness related wear and breakage mechanisms. The improved hardness can be achieved with a smaller WC grain size or a lower binder phase content but smaller WC grains tends to grow more during sintering and thus lowering the hardness. The hardness can be controlled through the binder phase content and through the control of the WC grain size during manufacturing and in the final product. The grain growth is also influenced by the sintering temperature and the sintering time. It has been found that a relatively low Cr content can suppress WC grain growth during sintering without being detrimental to the properties of the cemented carbide for percussive drilling. The Cr content should be low enough so that preferably all Cr is dissolved in the Co binder phase during sintering and no chromium-carbide is precipitated in the binder phase during cooling of the sintered cemented carbide. It has been found to be beneficial to use a lower Cr content in relation to Co than what previously has been known for cemented carbide for percussive rock drilling. This allows the hardness to be increased to above 1520 HV30, measured in the bulk of the insert, through a smaller WC grain size. However if the hardness is too high, above 1660 HV30 measured in the bulk of the insert, the cemented carbide can become too brittle for percussive rock drilling resulting in higher wear.

To further improve the wear properties a hardness of 1520 Hv30, preferably 1520-1660 Hv30 in combination with a toughness of $K1_c \geq 10.0$ measured in the bulk of the insert, and surface toughness of $K1_c \geq 12.0$ measured at 0.5 mm below the surface of the insert body is used. The increase of surface toughness can be achieved through a treatment process where the sintered cemented carbide insert bodies are set in motion to collide with each other in a controlled manner to induce mechanical deformation hardening in the surface of the bodies. This treatment also increases the surface hardness of the insert bodies.

According to an embodiment the cemented carbide of the insert has a mean WC grain size value of 0.60-0.95 μm According to an embodiment the insert comprises 5.4-6.4 wt % Co.

According to a further embodiment the insert comprises 5.6-6.2 wt % Co.

According to yet an embodiment the insert comprises 0.20-0.30 wt % Cr and/or has a Cr/Co weight ratio of 0.025-0.055, preferably 0.031-0.055.

According to another embodiment the insert comprises 0.20-0.30 wt % Cr and/or has a Cr/Co weight ratio of 0.031-0.042.

A lower Cr/Co weight ratio will make sure that all Cr is dissolved in the binder phase after sintering.

According to a further embodiment of the insert the mean WC grain size value is 0.65-0.90 μm According to a further embodiment of the insert the mean WC grain size value is 0.70-0.90 μm.

According to a further embodiment of the insert the hardness is ≤1600 Hv30, preferably 1520-1600 Hv30 measured in the bulk. Having a hardness up to 1600 Hv30 limits brittleness induced wear and breakage mechanisms.

According to a further embodiment the insert has a surface hardness of ≥1530 Hv30, preferably 1530-1680 Hv30, measured at 0.5 mm below the surface of the body in a transverse direction to the longitudinal axis of the insert.

According to a further embodiment the insert has a surface hardness of ≥1540 Hv30, preferably 1540-1700 Hv30, measured at 0.5 mm below the surface of the body in a transverse direction to the longitudinal axis of the insert.

According to a further embodiment the insert has a bulk toughness of $K1_c \geq 11.0$ measured in the bulk at the center of the longitudinal axis through the center of the insert, or ≥5 mm from any surface of the insert, preferably in a transverse direction to the longitudinal axis through the center of the insert, and/or a surface toughness of $K1_c \geq 13.0$ measured at 0.5 mm below the surface of the body in a transverse direction to the longitudinal axis of the insert.

According to a further embodiment the insert has a bulk toughness of $K1_c \geq 11.0$ measured in the bulk at the center of the longitudinal axis through the center of the insert, or 5 mm from any surface of the insert, preferably in a transverse direction to the longitudinal axis through the center of the insert, and/or a surface toughness of $K1_c \geq 14.0$ measured at 0.5 mm below the surface of the body in a transverse direction to the longitudinal axis of the insert.

It is beneficial if the toughness is as high as possible given the limitations set by Co content, mean WC grain size and hardness.

According to a further embodiment the cemented carbide may further comprise a cubic carbide $(W_xMi_{1-x})C$ phase (M=Ti, Ta, Nb, Zr or Hf) 0-0.2 wt %, preferably 0-0.15 wt %, most preferably 0.05-0.15. This is usually added as metal carbide such as for example TiC or TaC to the powder mixture during manufacturing.

According to one embodiment of the invention the insert contains Co, Cr, and optionally cubic carbides, in the prescribed amounts and balance WC and unavoidable impurities.

The present invention also relates to a drill bit comprising one or more drill bit inserts according to the invention. The drill bit can be used for percussive drilling and/or for rotary drilling.

The present invention also relates to the use of such a drill bit for drilling.

BRIEF DESCRIPTIONS OF DRAWINGS

FIG. 1. Cross section made through the longitudinal axel (A) at the center of a drill bit insert.

Figure 2:
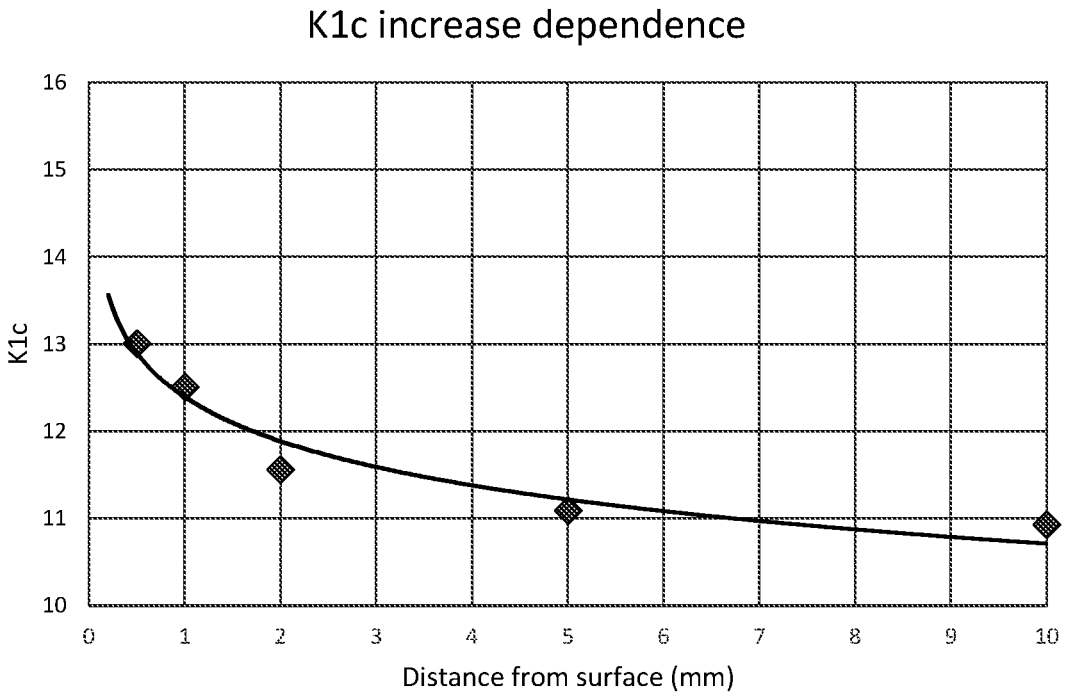

FIG. 2. Toughness increase due to surface treatment of AC9. Here represented by the measured values from inserts having a diameter of 14.5 mm and having a height of 26.2 mm.

Figure 3:
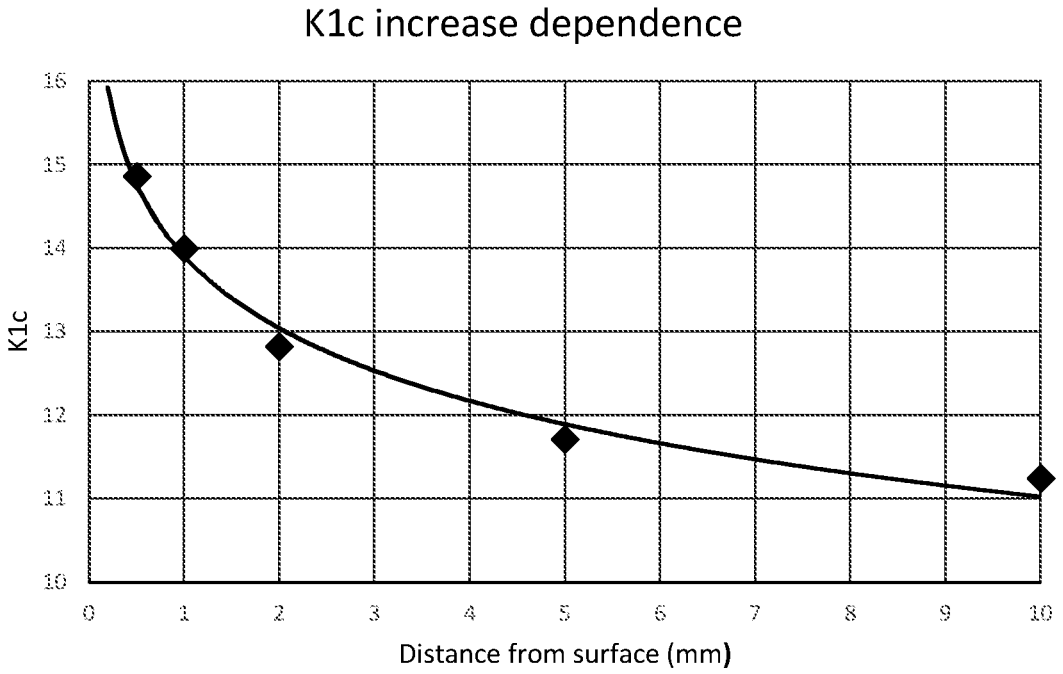

FIG. 3. Toughness increase due to surface treatment of AC10. Here represented by the measured values from inserts having a diameter of 14.5 mm and having a height of 26.2 mm.

Figure 4:
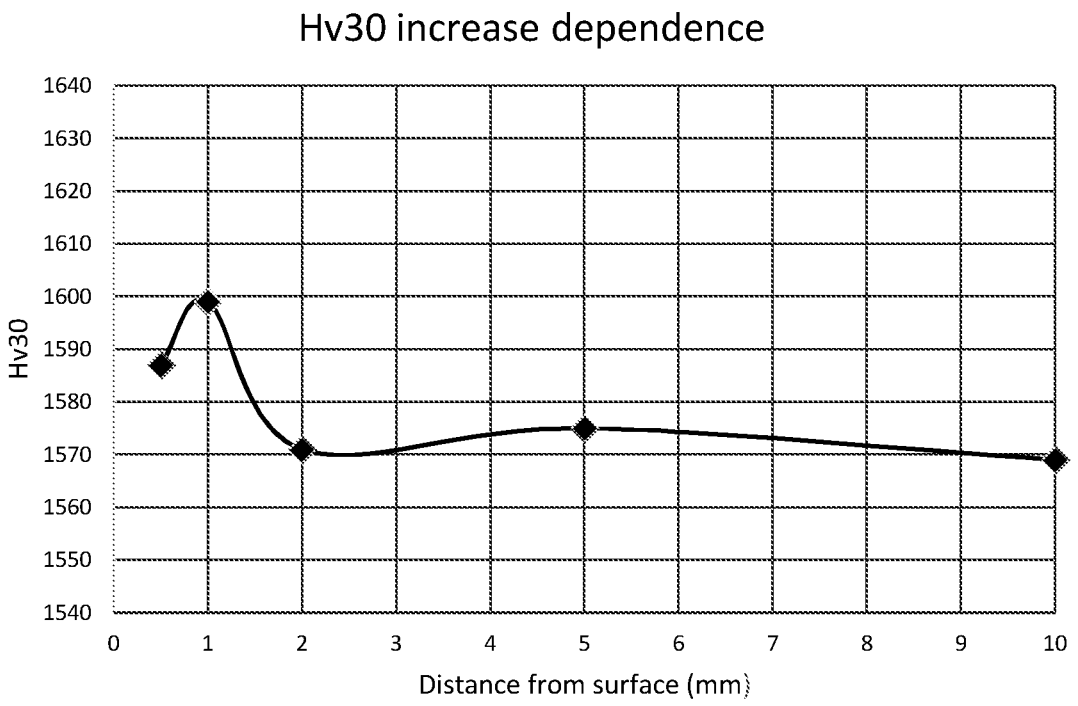

FIG. 4. Hardness increase due to surface treatment of AC9. Here represented by the measured values from inserts having a diameter of 14.5 mm and having a height of 26.2 mm.

Figure 5:
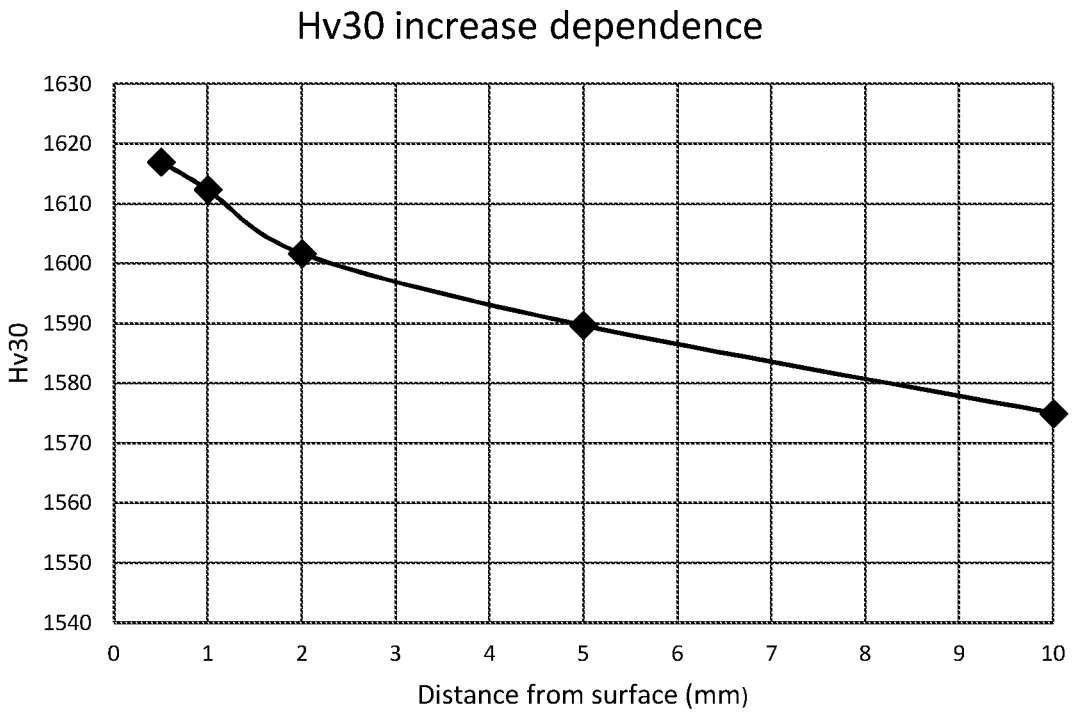

FIG. 5. Hardness increase due to surface treatment of AC10. Here represented by the measured values from inserts having a diameter of 14.5 mm and having a height of 26.2 mm.

Figure 6:
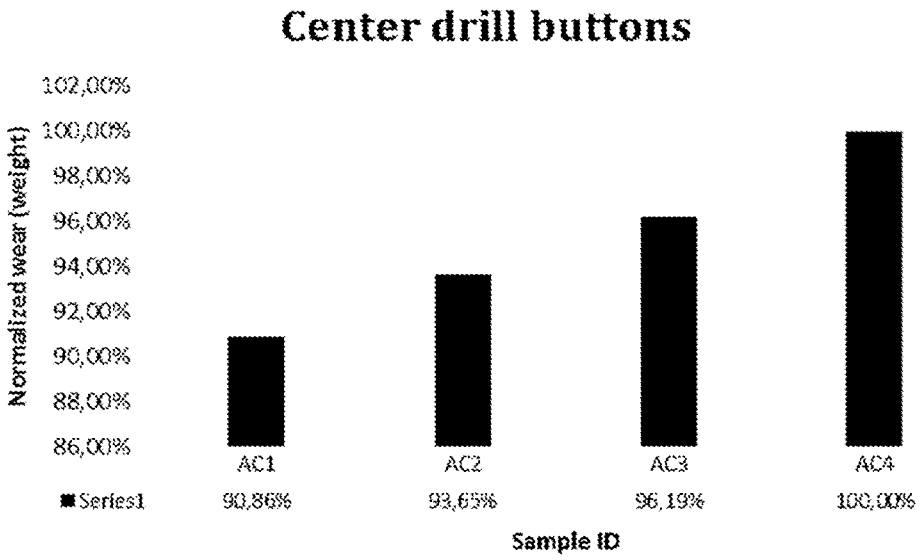

FIG. 6. Wear data from in-house testing of AC1, AC2, AC3 and AC4 compositions.

Figure 7:
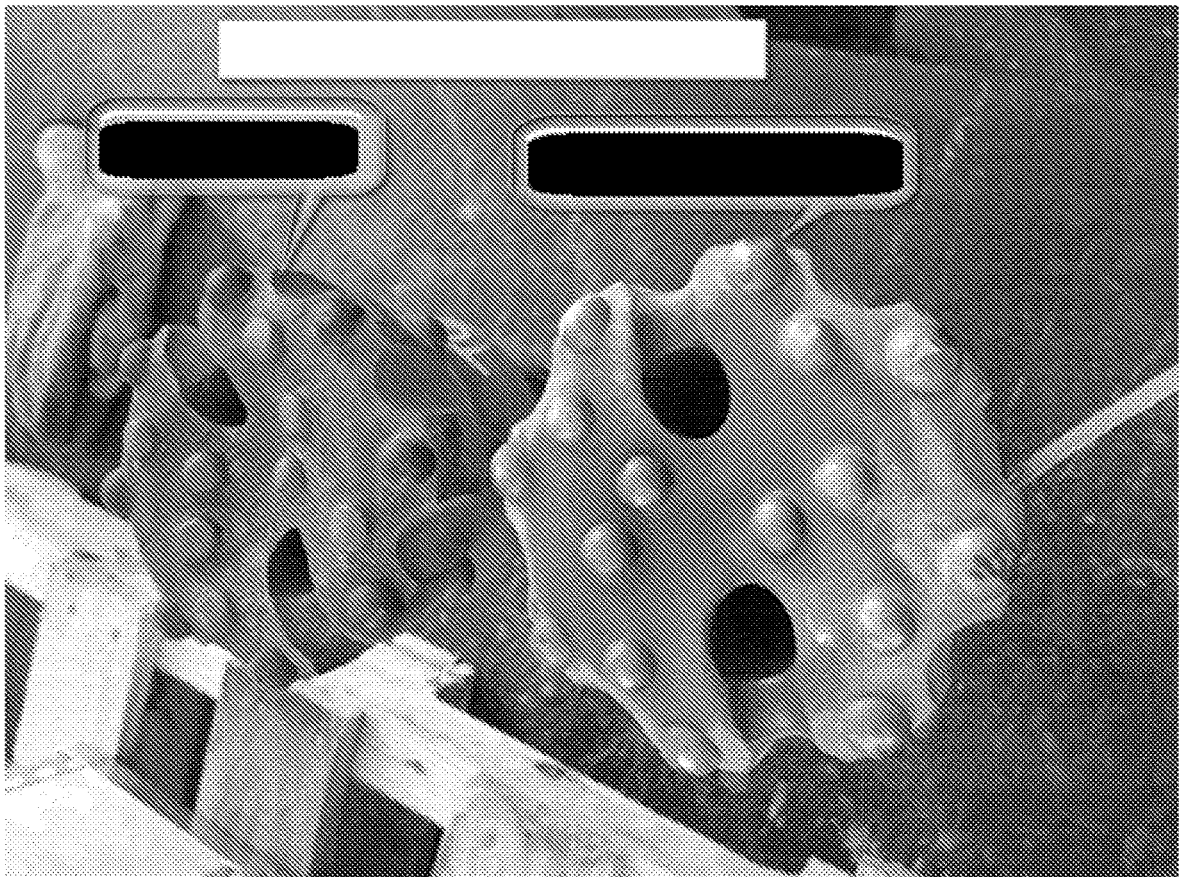

FIG. 7. Test bits used for field testing. Shows major drilling, underground work with COP 44 STD. The Cop 44 is a DTH hammer from the company Atlas Copco.

DETAILED DESCRIPTION OF EMBODIMENTS

The invention is here described in detail in relation to a manufacturing process and examples.

Composition and Powder Preparation

Powder batches with compositions according to Table 1 were made according to established cemented carbide manufacturing processes.

Powders of WC, Co, C and grain refining additives such as $Cr_3C_2$ and NbC according to the examples in Table 1 were milled in a ball mill for in total 40 to 60 hours. The desired carbon content was adjusted through the addition of granulated carbon powder before milling. The adjustments were based on the analyzed C-content of the WC and the desired total C-content (Cp) of the powder batch. In Table 1 the calculated corresponding Cr and Nb content is listed. The weight of Cr and Nb in grams is listed as $Cr_3C_2$ and NbC respectively. The corresponding content of Co, Cr and Nb is listed in wt %.

Wet milling conditions was used, using ethanol as milling liquid, with an addition of 2 wt % polyethylene glycol (PEG 3350) as organic binder and 12 kg WC-Co milling balls in a 5 liter mill.

After milling, the slurry was spray-dried in N-atmosphere.

The WC grain size measured as FSSS was before milling about 3 μm.

TABLE 1

Composition of the cemented carbide inserts.

| Example | Cp | WC | Co | Cr | Nb | C | Milling time (h) |
|---|---|---|---|---|---|---|---|
| AC1 | 5.83 | Balance | 6.0 | 0.15 | — | C-adj. | 40 |
| | | 3283 g | 210 g | 6.04 g | — | 1.30 g | |
| AC2 | 5.83 | Balance | 6.0 | 0.30 | — | C-adj. | 40 |
| | | 3277 g | 210 g | 12.08 g | — | 0.98 g | |
| AC3 | 5.83 | Balance | 6.0 | 0.15 | 0.15 | C-adj. | 40 |
| | | 3277 g | 210 g | 6.04 g | 5.90 g | 1.08 g | |
| AC4 | 5.81 | Balance | 6.0 | — | — | C-adj. | 40 |
| | | 3289 g | 210 g | — | — | 0.59 g | |
| AC5 | 5.85 | Balance | 5.6 | — | — | C-adj. | 40 |
| | | 3304 g | 196 g | — | — | 0.43 g | |
| AC6 | 5.84 | Balance | 5.8 | — | — | C-adj. | 40 |
| | | 3296 g | 203 g | — | — | 0.51 g | |
| AC7 | 5.85 | Balance | 5.85 | 0.15 | — | C-adj. | 40 |
| | | 3289 g | 205 g | 6.04 g | — | 0.37 g | |
| AC8 | 5.85 | Balance | 5.6 | 0.15 | — | C-adj. | 40 |
| | | 3289 g | 196 g | 6.04 g | — | 0.11 g | |
| AC9 | 5.85 | Balance | 6.0 | 0.25 | — | C-adj. | 60 |
| | | 3289 g | 210 g | 10.06 g | — | 1.40 g | |
| AC10 | 5.85 | Balance | 6.0 | 0.25 | — | C-adj. | 60 |
| | | 3289 g | 210 g | 10.06 g | — | 1.40 g | |

The compositions according to AC1, AC2, AC3, AC7, AC8, AC9 and AC10 in Table 1 are compositions that are within the scope of the invention. The compositions AC4, AC5 and AC6 in table 1 are comparative examples with compositions that are outside the scope of the present invention.

Pressing of Powder and Sintering

Green bodies were manufactured from the powder by uniaxial pressing. The form was standard mining drill inserts. After pressing the inserts were sintered by using Sinter-HIP in 30 bar Argon-pressure at 1480° C. for 0.5 hour.

The sintered cemented carbide materials are essentially free from chromium carbide precipitations, but precipitations of cubic $(W_xNb_{1-x})C$ phase can be found in the sintered structure of AC3.

Grinding

The inserts were grinded to the required diameter by means of centerless grinding. The diameters of the inserts presented in FIGS. 2, 3, 4 and 5, where of approximate diameter 14.5 mm and an approximate height of 26.2 mm.

High Energy Treatment

The inserts were treated with a high energy process in accordance with process disclosed in patent application no. PCT/SE2016/050451 with publication no. WO2016/186558. The drill bit inserts were treated with a high energy treatment process in a centrifuge in order to increase the toughness and hardness. The centrifuge comprises a chamber formed by a stationary side wall and a bottom which is rotatable around a rotation axis, the bottom comprising 6 protrusions which extends between the rotation axis and the side wall, the side wall comprising pushing elements (vertical ridges) arranged around a periphery of the side wall to break the upward and circular motion of the insert bodies. The insert bodies were treated by rotating the bottom of the container with the protrusions around the rotation axis. The insert bodies are then set in motion to collide with each other. The pushing elements breaks the upward and circular motion of the inserts by slightly pushing them from the side wall during the rotation of the bottom. The insert bodies are thus treated in a controlled manner and the combined volume of insert bodies forms a toroidal shape at the lower part of the container where they move around and collide with each other with a limited relative motion to avoid uncontrolled large collisions which tend to give cracks and chippings.

The chamber used was 350 mm, in diameter. The method uses water in the chamber. The process water was mixed with a detergent. To fill the container to a desired level when this small amount of test inserts were treated, cemented carbide bodies of similar or smaller size were added so that the total weight of the treated cemented carbide bodies was about 40 kg. The program used according to this method was divided in several steps according to table 2 and 4.

TABLE 2

High energy treatment program AC1-AC4

| RPM (rotations/minutes] | Time [minutes] incl. start/stop |
|---|---|
| 220 | 20 |
| 240 | 10 |
| 280 | 20 |
| 300 | 60 |

TABLE 3

High energy treatment program AC9

| RPM (rotations/minutes] | Time [minutes] incl. start/stop |
|---|---|
| 220 | 50 |
| 230 | 30 |
| 240 | 30 |
| 250 | 30 |

TABLE 4

High energy treatment program AC10

| RPM (rotations/minutes] | Time [minutes] incl. start/stop |
|---|---|
| 220 | 50 |
| 230 | 30 |
| 240 | 30 |
| 250 | 30 |
| 280 | 30 |
| 300 | 90 |
| 350 | 60 |
| 380 | 60 |

Investigation of Material Properties

After the treatment the drill inserts were investigated to verify the effect. Details on the sintered material properties are shown in Table 5. The hardness is the bulk hardness measured at the center of the insert where the hardness is not much affected by the treatment. The surface hardness is higher according to the high energy treatment.

The addition of niobium in AC3 resulted in a precipitation of trace amounts of brittle cubic carbide phase (($W_xNb_{1-x}$)C). Addition of only chromium did not result in the precipitation of any chromium-carbide containing hard phases. The inserts were investigated using light optical (LOM) and scanning electron microscopy (SEM).

The compositions without Cr, AC4-AC6 would require considerably lower sintering temperature to achieve similar hardness as the compositions that are within the scope of the invention. Even when sintering the AC4 composition at 1400° C. the desired hardness was not reached. Due to the low hardness of AC5 and AC6 these were not field tested.

TABLE 5

Details on materials produced according to AC 1-10.

| | Coercivity [kA/m] | MS* | Density [g/cm$^3$] | Hardness [Hv30] | $K1_c$ [MN*m^(−3/2)] | Sintering Temp. [° C.] |
|---|---|---|---|---|---|---|
| AC1 (comparative) | 13.6 | 88.8 | 14.92 | 1515 | 10.4 | 1480 |
| AC2 (invention) | 13.7 | 88.8 | 14.92 | 1520 | 10.3 | 1480 |
| AC3 (invention) | 13.9 | 90.4 | 14.91 | 1520 | 10.3 | 1480 |
| AC4 (comparative) | 12.6 | 90.4 | 15.00 | 1486 | 11.2 | 1480 |
| | 13.3 | 92.0 | 14.99 | 1514 | 10.2 | 1400 |
| AC5 (comparative) | 11.1 | 98.4 | 15.00 | 1438 | 11.3 | 1480 |
| AC6 (comparative) | 11.6 | 87.2 | 15.06 | 1469 | 10.8 | 1480 |
| AC7 (invention) | 13.5 | 87.2 | 14.98 | 1528 | 10.2 | 1480 |
| AC8 (invention) | 13.3 | 88.8 | 14.98 | 1521 | 10.4 | 1480 |
| AC9 (invention) | 14.8 | 90.4 | 14.90 | 1564 | 10.2 | 1480 |
| AC10(invention) | 14.7 | 90.5 | 14.90 | 1562 | 11.0 | 1480 |

*MS = Percentage of magnetic cobalt.

The inserts according to the invention in Table 5 have a mean WC grain size in the range of 0.60-0.95 μm.

The toughness and hardness values in Table 5 were measured at the bulk where the material is nearly unaffected by the high energy treatment. The toughness (K1c) of the material was measured using the standard ISO 28079:2009, Palmqvist toughness test for hard metals. Crack length was measured according to method B. For hardness ISO 3878: 1983, Hard metals—Vickers hardness test, was used. Density is measured according to ISO 3369-1975, Coercivity according to ISO 3326-1975 and MS can be measured according to ASTM B886:2008.

FIG. 1. illustrates a cross section made through the longitudinal axis (A) through the center of a drill bit insert. The insert in FIG. 1 is not to scale and only intended to schematically show the principle for the positions for hardness and toughness measurements. The figure shows indentations for hardness and toughness measurements at 0.5, 1.0 (offset), 2.0, 5.0 and 10.0 mm from the top of the insert surface seen at the top of the figure. The 1.0 mm indent is offset to the longitudinal axis (A) to position it sufficiently far from the 0.5 mm indent. Here it is shown how hardness and toughness is measured in the bulk at the center of the longitudinal axis (A) through the center of the insert, or ≥5 mm from any surface of the insert, preferably in a transverse direction to the longitudinal axis through the center of the insert. The direction may be perpendicular to the longitudinal axis (A). The measurement position≥5 mm from any surface of the insert body is preferably used if the diameter and length of the insert is sufficiently large. Otherwise the measurement point for the bulk value should be chosen close to or at the center of the insert along the longitudinal axis (A). The intention is to measure the bulk hardness and toughness at a position where the material is nearly unaffected by the high energy treatment.

It is also shown in FIG. 1. how the hardness and toughness is preferably measured in the surface region, as a measurement value of surface hardness, through an indent positioned at a distance of 0.5 mm from the top surface of the insert in a transverse direction to the longitudinal axis (A). The direction may be perpendicular to the longitudinal axis (A) as shown in FIG. 1. However the surface hardness and toughness can also be measured at other positions around the surface perimeter of the insert.

Also, for the inserts according to the AC9 and AC10 composition, the toughness and hardness of the material through the length of the longitudinal axis of the drill bit inserts was measured. It was found that an increase of surface toughness and hardness had been achieved. The data from the investigation of the toughness of the drill bit inserts can be seen in graph in FIGS. 2, 3, 4 and 5. As seen in FIGS. 2 (AC9) and 3 (AC10) the toughness increases towards the surface and as seen in FIGS. 4 (AC9) and 5 (AC10) the hardness also increases towards the surface.

To the data points in FIG. 2 and FIG. 3, a curve fit toward a point 0.2 mm from the surface has been done with the assumption that the effect of the high energy processing is decaying logarithmically with the distance from the surface. Measurement of toughness ($K1_C$) from indents with Hv30 cannot be done with good accuracy and repeatability closer than 0.5 mm from the surface. Lower loads like Hv10 or HO results in insufficient crack length for accurate and repeatable measurement of K1c.

Lab Testing: Top-Hammer Percussive Drilling Test in Swedish Hard Granite.

Compositions AC1-AC4 were investigated (AC4 being a standard reference composition for the application).

As can be seen from the results in FIG. 6 the inserts with the AC1, AC2 and AC3 composition were better than the reference. The hardness of the tested drill inserts are in the low range on the specified hardness target for the current invention. From the results of this test it was concluded that 1520 Hv30 should be the low limit for hardness to be part of the scope of the present invention.

Field Test

The test was conducted underground using a DTH 4.75 inch drill bit and an Atlas Copco COP 44 STD hammer.

The drill bit inserts were tested against the best performing bit, with PCD (Poly Crystalline Diamond) coated periphery drill bit inserts and the current wear resistant standard cemented carbide grade containing about 6 wt % Co and no Cr. The test bits had insert made according to the AC9 composition and properties. Both bits were drilled for 800 feet/244 m. The wear of the periphery drill inserts were as expected higher than for the PCD-drill inserts, but the inserts according to AC9 were performing almost as good and well above the expectations. The PCD drill inserts cost roughly 10 times more to produce than the cemented carbide drill inserts according to the present invention. When comparing the wear of the center drill bit inserts it was found that the average diameter of the phase wear (flat spot on the worn insert) was approx. 15 mm (⌊=19 mm) for the current most wear resistant standard Atlas Copco Secoroc grade. Whereas the phase wear of the AC9 drill bit inserts were at an average 1-2 mm. This is shown in FIG. 7 where the bit having PCD coated periphery inserts is shown to the left and the bit having AC9 inserts is shown to the right.

For the purpose of investigating an insert body with a cemented carbide material according to this disclosure ISO 28079:2009, Palmqvist toughness test for hard metals, is preferably used for toughness tests. For hardness ISO 3878: 1983, Hard metals—Vickers hardness test, is preferably used. For determination of (arithmetic) mean WC grain size value according to this disclosure the linear-intercept technique according to ISO 4499-2:2008 is preferably used. Preferably using SEM micrographs.

Even though the embodiments described in this application relates to percussive drilling the inserts according to the present invention may also be utilized for different types of drill bits used for rotary drilling or a combination of rotary and percussive drilling.

The invention has been described with reference to specific embodiments. It is obvious to a person skilled in the art that other embodiments are possible within the scope of the present invention as defined in the claims. Terms such as "comprising", "comprised of" or "including" in this application is used in a non-exclusive meaning, such that all comprised or included content may be completed with additional content.

The invention claimed is:

1. A drill bit insert for rock drilling comprising a sintered cemented carbide body having a bulk and a surface, and including a hard phase of tungsten carbide (WC) and a binder phase wherein the cemented carbide body comprises:

5.0-7.0 wt % Co, 0.10-0.35 wt % Cr, and balance WC including possible impurities;

wherein the cemented carbide body has a Cr/Co weight ratio of 0.015-0.058 and a mean WC grain size of 0.60-0.95 μm, wherein the sintered cemented carbide body has a bulk hardness of 1520-1660 Hv30 and a bulk toughness of $Kl_c \geq 10.0$ both measured in the bulk at a measurement point≥5 mm from the surface of the body, and a mechanically induced surface toughness of $Kl_c \geq 12.0$ measured at a measurement point 0.5 mm below the surface of the body.

2. The drill bit insert according to claim 1, wherein the body comprises 5.4-6.4 wt % Co.

3. The drill bit insert according to claim 1, wherein the body comprises 5.6-6.2 wt % Co.

4. The drill bit insert according to claim 1, wherein the body comprises 0.20-0.30 wt % Cr and/or a Cr/Co weight ratio of 0.031-0.055.

5. The drill bit insert according to claim 1, wherein the body comprises 0.20-0.30 wt % Cr and/or a Cr/Co weight ratio of 0.031-0.042.

6. The drill bit insert according to claim 1, wherein the mean WC grain size of the body is 0.65-0.90 μm.

7. The drill bit insert according to claim 1, wherein the mean WC grain size of the body is 0.70-0.90 μm.

8. The drill bit insert according to claim 1, wherein the bulk hardness is 1520-1600 Hv30 measured in the bulk at a measurement point≥5 mm from the surface of the body.

9. The drill bit insert according to claim 1, wherein the surface hardness is 1530-1680 Hv30 measured at a measurement point 0.5 mm below the surface of the body.

10. The drill bit insert according to claim 1, wherein the hardness is 1540-1700 Hv30, measured at a measurement point 0.5 mm below the surface of the body.

11. The drill bit insert according to claim 1, wherein the toughness is $Kl_c \geq 11.0$ measured in the bulk a measurement point≥5 mm from any the surface of the insert body, and/or $Kl_c \geq 13.0$ measured at a measurement point 0.5 mm below the surface of the body.

12. The drill bit insert according to claim 1, wherein the toughness is $Kl_c \geq 11.0$ measured in the bulk a measurement point≥5 mm from the surface of the body, and/or $Kl_c \geq 14.0$ measured at a measurement point 0.5 mm below the surface of the body.

13. The drill bit insert according to claim 1, wherein the cemented carbide further comprises a cubic carbides $(W_xM_{1-x})C$ phase (M=Ti, Ta, Nb, Zr or Hf) up to 0.2 wt %.

14. A drill bit comprising one or more drill bit inserts according to claim 1.

* * * * *